US006688928B2

(12) United States Patent
Gokan et al.

(10) Patent No.: US 6,688,928 B2
(45) Date of Patent: Feb. 10, 2004

(54) PERSONAL WATERCRAFT HAVING ENGINE WITH SUPERCHARGER INCORPORATED THEREIN

(75) Inventors: Yoshitsugu Gokan, Saitama (JP); Kazunori Okada, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/173,847

(22) Filed: Jun. 19, 2002

(65) Prior Publication Data

US 2003/0017765 A1 Jan. 23, 2003

(30) Foreign Application Priority Data

Jul. 19, 2001 (JP) ..... 2001-219322

(51) Int. Cl.[7] ..... B63H 21/10
(52) U.S. Cl. ..... 440/88 L; 440/88 A; 123/196 R
(58) Field of Search ..... 440/88 A, 88 L, 440/89 R, 89 J; 123/196 R

(56) References Cited

U.S. PATENT DOCUMENTS 4,009,972 A * 3/1977 Sarle ..... 417/407
4,068,612 A * 1/1978 Meiners ..... 440/89
4,559,782 A * 12/1985 Ritchey et al. ..... 60/605.3
4,562,697 A * 1/1986 Lawson ..... 60/599
4,752,193 A * 6/1988 Horler ..... 417/407
4,926,641 A * 5/1990 Keller ..... 60/605.3
5,000,143 A * 3/1991 Brown ..... 123/196 S
5,072,583 A * 12/1991 Urushihara et al. ..... 60/313
5,079,921 A * 1/1992 McCandless et al. ..... 60/602
5,402,643 A * 4/1995 Buchanan et al. ..... 60/605.3
5,894,825 A * 4/1999 Duerr ..... 123/196 S
6,446,592 B1 * 9/2002 Wilksch ..... 123/196 R
6,537,115 B2 * 3/2003 Suganuma et al. ..... 123/198 C

FOREIGN PATENT DOCUMENTS

JP 2001140613 A 5/2001

* cited by examiner

*Primary Examiner*—S. Joseph Morano
*Assistant Examiner*—Andrew Wright
(74) *Attorney, Agent, or Firm*—Birch, Stewart, Kolasch & Birch, LLP

(57) ABSTRACT

A personal watercraft having an engine provided in a body formed from a hull and a deck, and a supercharger provided for the engine. An oil exit of the supercharger is disposed higher than an oil surface in the oil pan when the engine is not running. An oil tank is provided on an extension line of a crankshaft. A one-way valve is interposed in an oil returning passage, which communicates with the oil exit of the supercharger. This configuration minimizes oil residing in the supercharger when an engine is not running, and thus reduces the degradation of the entire oil supply for the engine and supercharger.

21 Claims, 13 Drawing Sheets

PERSONAL WATERCRAFT HAVING ENGINE WITH SUPERCHARGER INCORPORATED THEREIN

CROSS-REFERENCE TO RELATED APPLICATIONS

The present application claims priority under 35 U.S.C. §119 to Japanese Patent Application No. 2001-219322, filed on Jul. 19, 2001, the entire contents thereof are hereby incorporated by reference.

BACKGROUND OF THE INVENTION

1. Field of the Invention

This invention relates to a personal watercraft having an engine with a supercharger incorporated therein. More particularly, the present invention relates to a supply passage of oil to the supercharger for the engine.

2. Description of Background Art

While the power source of most conventional personal watercrafts is a 2-cycle engine, in order to cope with required reductions in pollution, 4-cycle engines have been employed increasingly in recent years. However, since the output power of 4-cycle engine is less than that of a 2-cycle engine of the same total stroke volume, superchargers are often incorporated in 4-cycle engines, in order to make up the power. The assignee of the present application has already proposed a personal watercraft having an engine with a supercharger incorporated therein as Japanese Patent Laid-Open No. 2001-140613.

In this personal watercraft, a 4-cycle engine 2 with a supercharger 3 is incorporated in the inside of a body 1 as shown in prior art FIGS. 11 and 12. The supercharger 3 is disposed on the rear side of the engine 2, and an oil tank 5 is disposed on the front side of the engine 2.

As shown in prior art FIG. 13, an oil pump 4 is provided below the oil tank 5 forwardly of the engine 2, and oil fed under pressure from the oil pump 4 is supplied through a pipe 6*d*, an oil filter 6 and another pipe 6*e* to a main gallery 2*a* of the engine 2. The oil is then supplied to various portions of the engine from the main gallery 2*a*.

Oil to a bearing portion 3*a* of the supercharger 3 is supplied from the main gallery 2*a* through an oil passage 2*d* in a lower side bearing portion 2*c* for a crankshaft 2*b*, another oil passage 2*f* in an upper side bearing portion 2*e* for the crankshaft 2*b* and a pipe 2*g*.

The oil having lubricated the bearing portion 3*a* of the supercharger 3 passes through a pipe 3*b*, and is recovered into an oil pan 2*i* provided at a lower portion of the engine. The oil is further recovered into the oil tank 5 from a pipe 6*a* through the oil pump 4.

Since the supercharger 3 is disposed on the rear side of the engine 2, and the oil tank 5 is disposed on the front side of the engine 2, the disadvantage of having the oil tank 5 and the oil in the oil tank 5 heated by the supercharger 3 is eliminated.

However, in the prior art described above, an exit 3*c* of oil having lubricated the bearing portion 3*a* of the supercharger 3 is disposed lower than an oil surface when the engine is not running. Therefore, after the engine stops, the oil resides in the bearing portion 3*a* of the supercharger 3. Since the temperature of the supercharger 3 is high immediately after the engine stops, the resident oil is liable to be carbonized. As a result, a problem occurs in that the entire oil supply used for circulation in the engine is liable to be degraded.

SUMMARY AND OBJECTS OF THE INVENTION

The object of the present invention is to provide a personal watercraft having an engine with a supercharger incorporated therein which minimizes the oil residing in the supercharger when the engine is not running, thus reducing the degradation of the entire oil supply. (In the description that follows, the terms "supercharger" and "turbocharger" are used interchangeably and have the same meaning).

In order to attain the object above, the present invention is directed to a personal watercraft having an engine with a supercharger incorporated therein, and includes a body formed from a hull and a deck, said engine being provided in said body and said supercharger being provided for said engine, and an oil exit of said supercharger disposed higher than an oil surface when said engine is not running.

Further, according to the present invention, the engine of the personal water craft is a dry sump engine, and an oil tank is provided on an extension line of a crankshaft of said engine.

In addition, the personal watercraft of the present invention also includes a one-way valve interposed in an oil returning passage which communicates with said oil exit of said super charger.

Since the engine is provided in the body formed from the hull and the deck, a supercharger is provided, and the oil exit of the supercharger is disposed higher than the oil surface when the engine is not running, the oil in the supercharger can be discharged quickly from the oil exit. As a result, the oil resident in the supercharger after the engine stops can be minimized, thus reducing the degradation of the entire oil supply.

Also, since the engine of the present invention is a dry sump type engine and the oil tank is provided on an extension line of the crankshaft thereof, the oil surface when the engine is not running can be set low. Thus, oil in the supercharger can be discharged quickly from the oil exit, and as a result, the deterioration of the entire oil is further reduced.

Moreover, since a one-way valve is interposed in the oil returning passage communicating between the oil exit of the supercharger, in a situation when the personal watercraft capsizes, the reverse flow of oil from the oil pan to the high-temperature supercharger can be eliminated. With this configuration, carbonization of oil can be prevented, and degradation of the entire oil supply can be reduced with a higher degree of certainty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an embodiment of the present invention is described with reference to the drawings.

Figure 1:
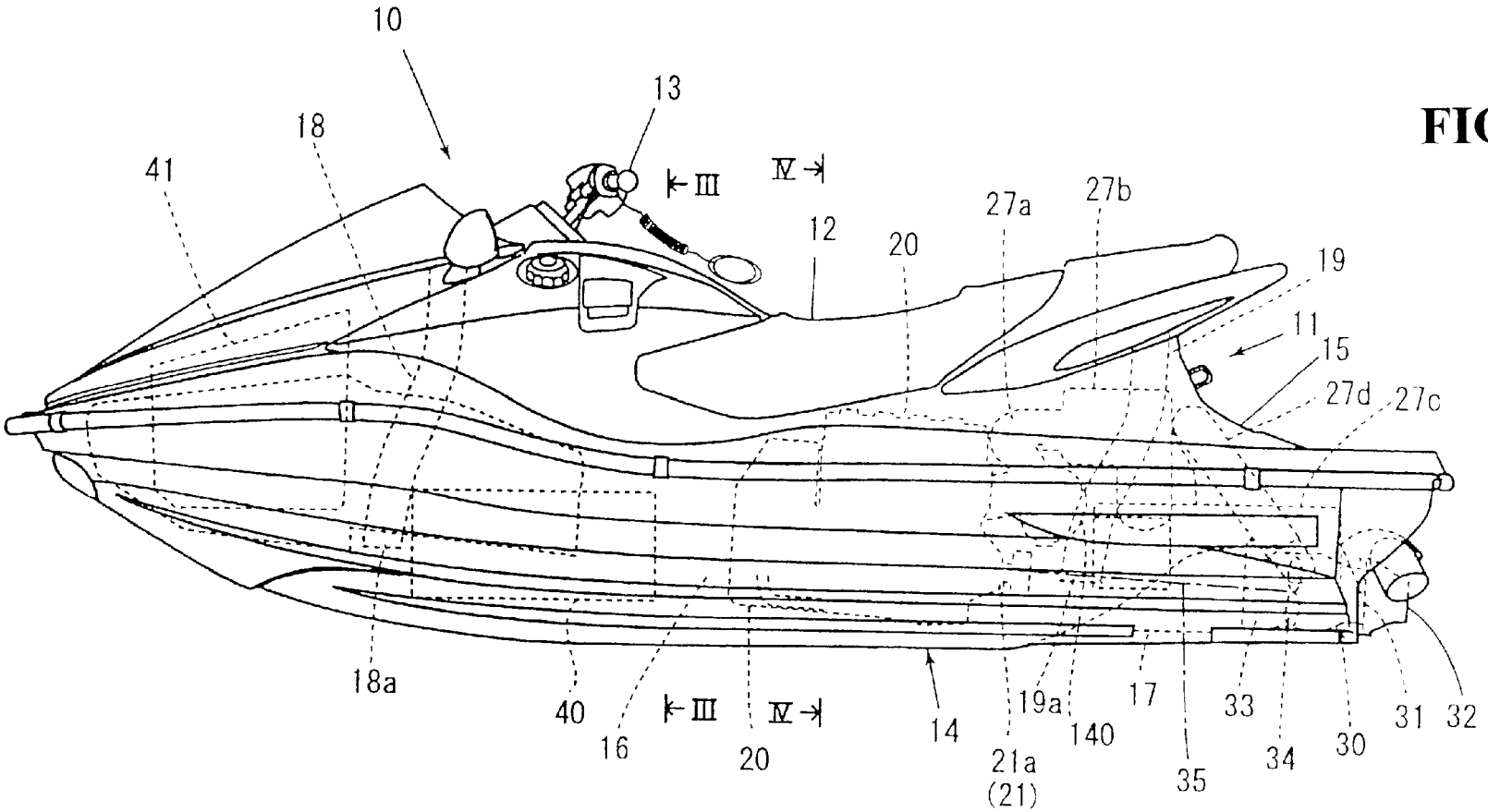
FIG. 1 is a schematic side elevational view showing an embodiment of a personal watercraft in which an engine with a supercharger is incorporated according to the present invention.
Figure 2:
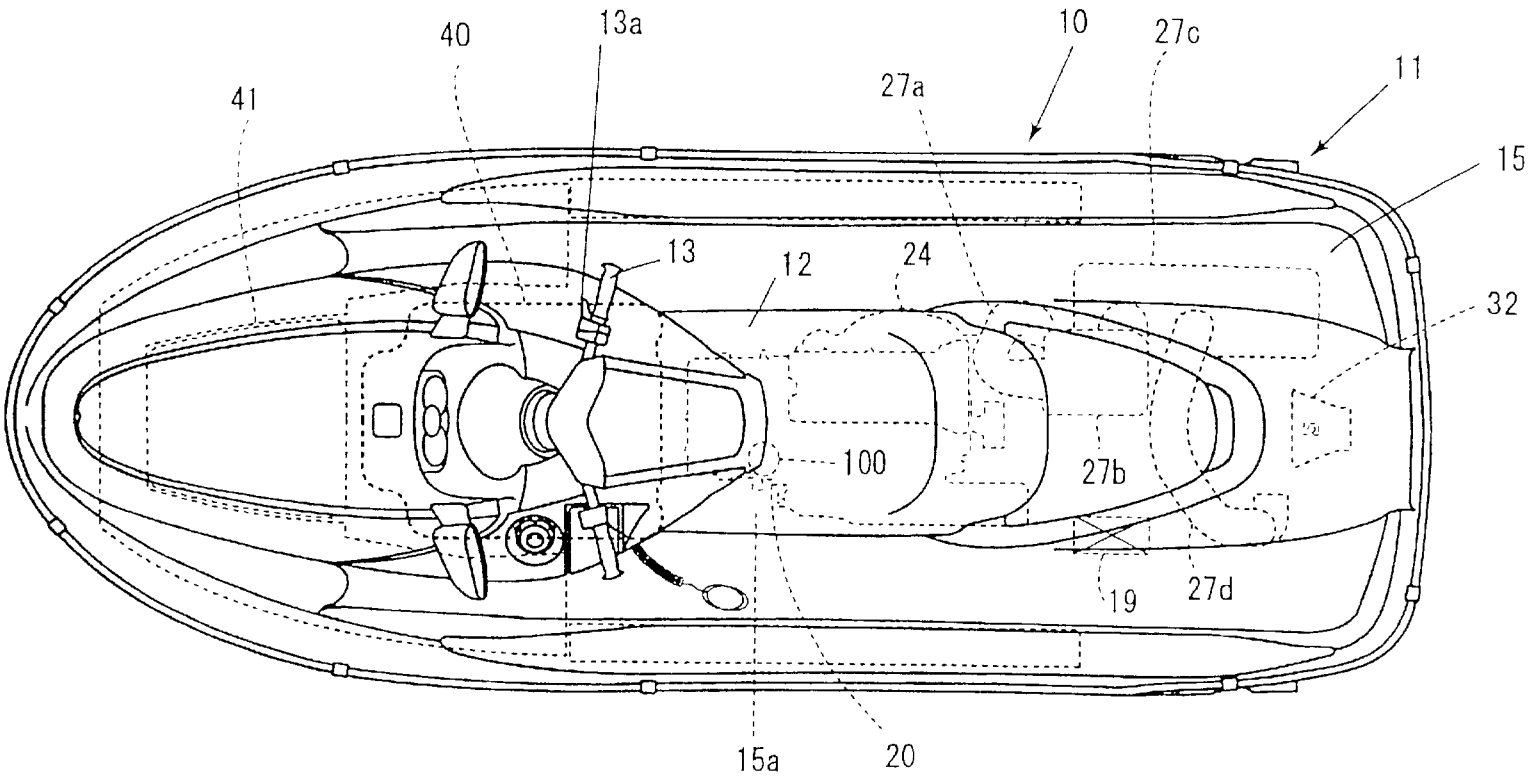
FIG. 2 is a plan view of the personal watercraft in FIG. 1.
Figure 3:
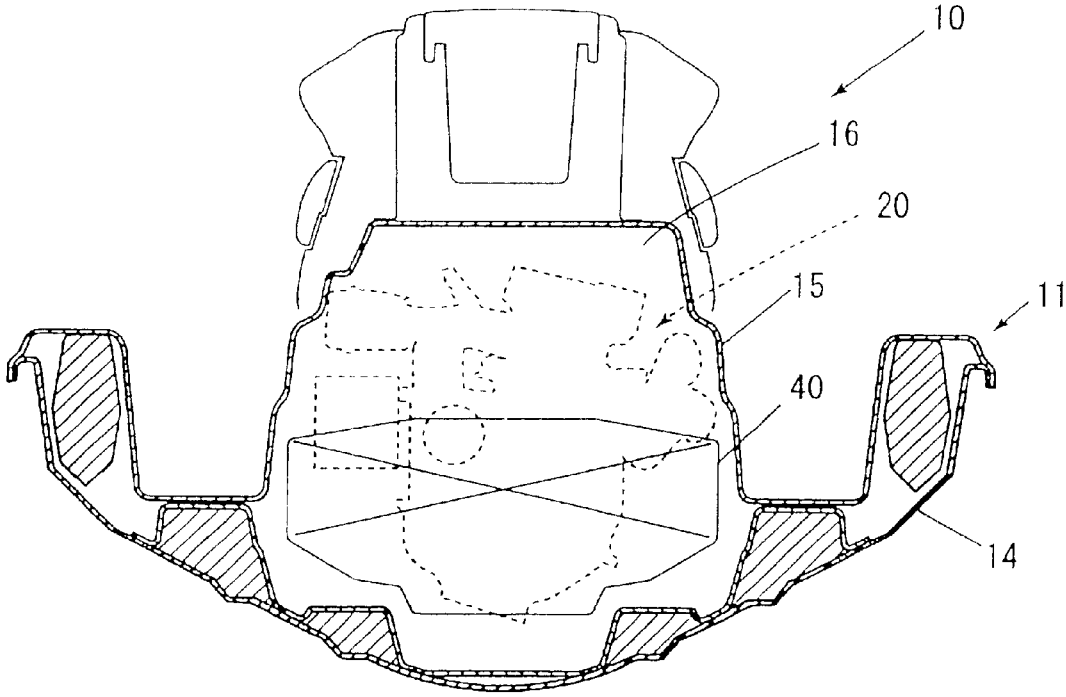
FIG. 3 is a partial enlarged sectional view (partly omitted sectional view) taken along line III—III of FIG. 1.

FIG. 1 is a schematic side elevational view showing an embodiment of a personal watercraft in which an engine with a supercharger is incorporated according to the present invention. FIG. 2 is a plan view of the same, and FIG. 3 is a partial enlarged sectional view (partly omitted sectional view) taken along line III—III of FIG. 1.

As shown in the figures (principally in FIG. 1), the personal watercraft 10 is a personal watercraft of the saddle type, and a driver can sit on a seat 12 on a body 11 and grip a steering handle 13 with a throttle lever to steer the personal watercraft 10.

The body 11 has a floating body structure wherein a hull 14 and a deck 15 are joined together such that a space 16 is formed in the inside thereof. In the space 16, an engine 20 is mounted on the hull 14. A jet pump (jet propulsion pump) 30 which acts as the propulsion means driven by the engine 20 is provided at a rear portion of the hull 14.

The jet pump 30 has a passage 33 extending from an intake 17 open to the bottom to a jet outlet 31 and a nozzle 32 open to the rear end of the body. An impeller 34 is disposed in the passage 33, and a shaft 35 of the impeller 34 is connected to an output power shaft 21*a* of the engine 20. Accordingly, if the impeller 34 is driven to rotate by the engine 20, then water taken in from the intake 17 is jetted from the nozzle 32 through the jet outlet 31 so that the body 11 is propelled. The driving speed of the engine 20, that is, the propelling force by the jet pump 30, is operated by a pivoting operation of a throttle lever 13*a* (refer to FIG. 2) of the steering handle 13 described above. The nozzle 32 is operatively associated with the steering handle 13 by an operation wire (not shown). The nozzle 32 is pivoted by an operation of the steering handle 13, and thus, the advancing direction of the boat can be changed. Fuel tank 40, and accommodation chamber 41 are also provided.

Figure 4:
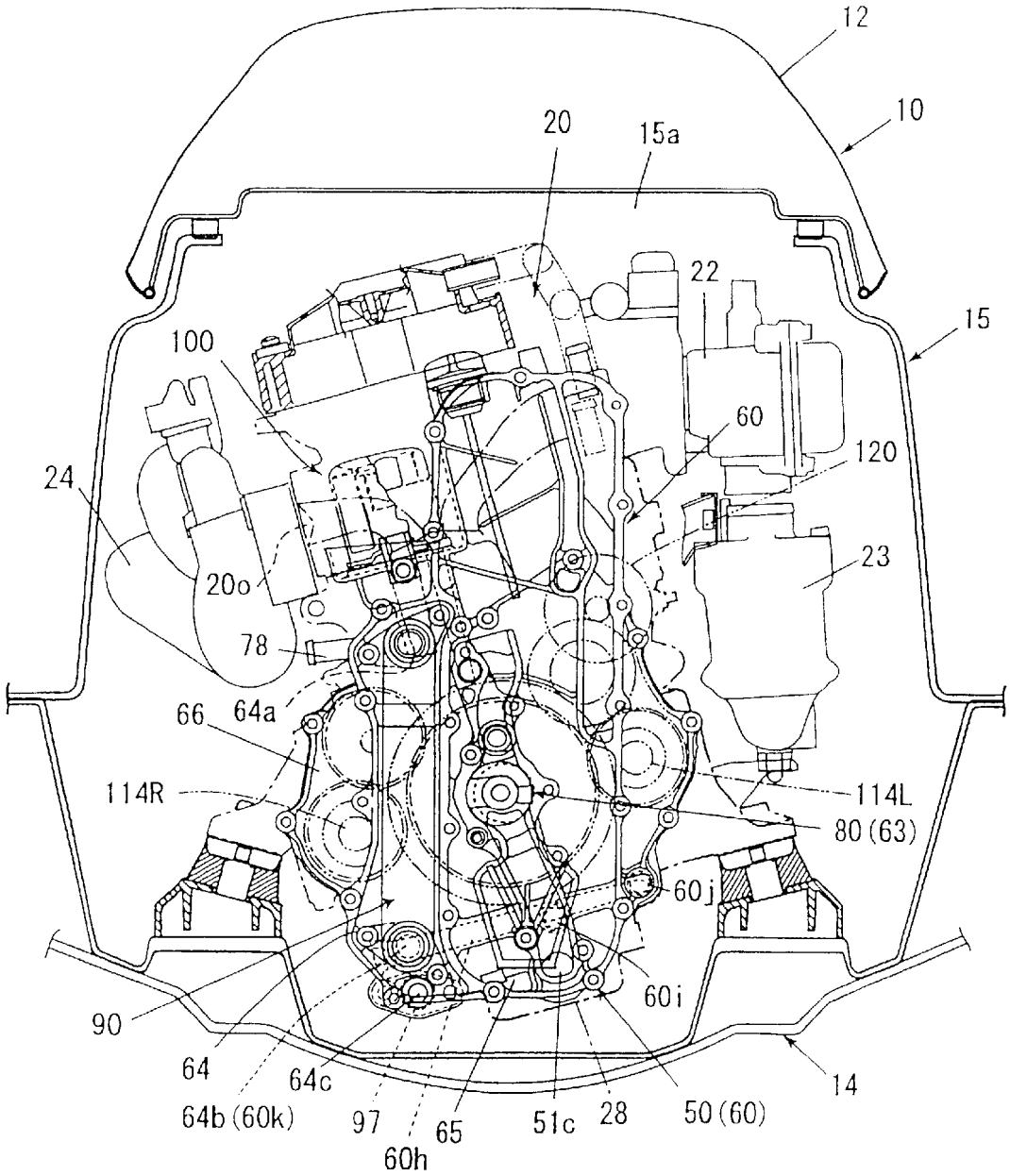
FIG. 4 is a view principally showing an engine 20 and is a partial enlarged sectional view (partly omitted sectional view) taken along line IV—IV of FIG. 1.
Figure 5:
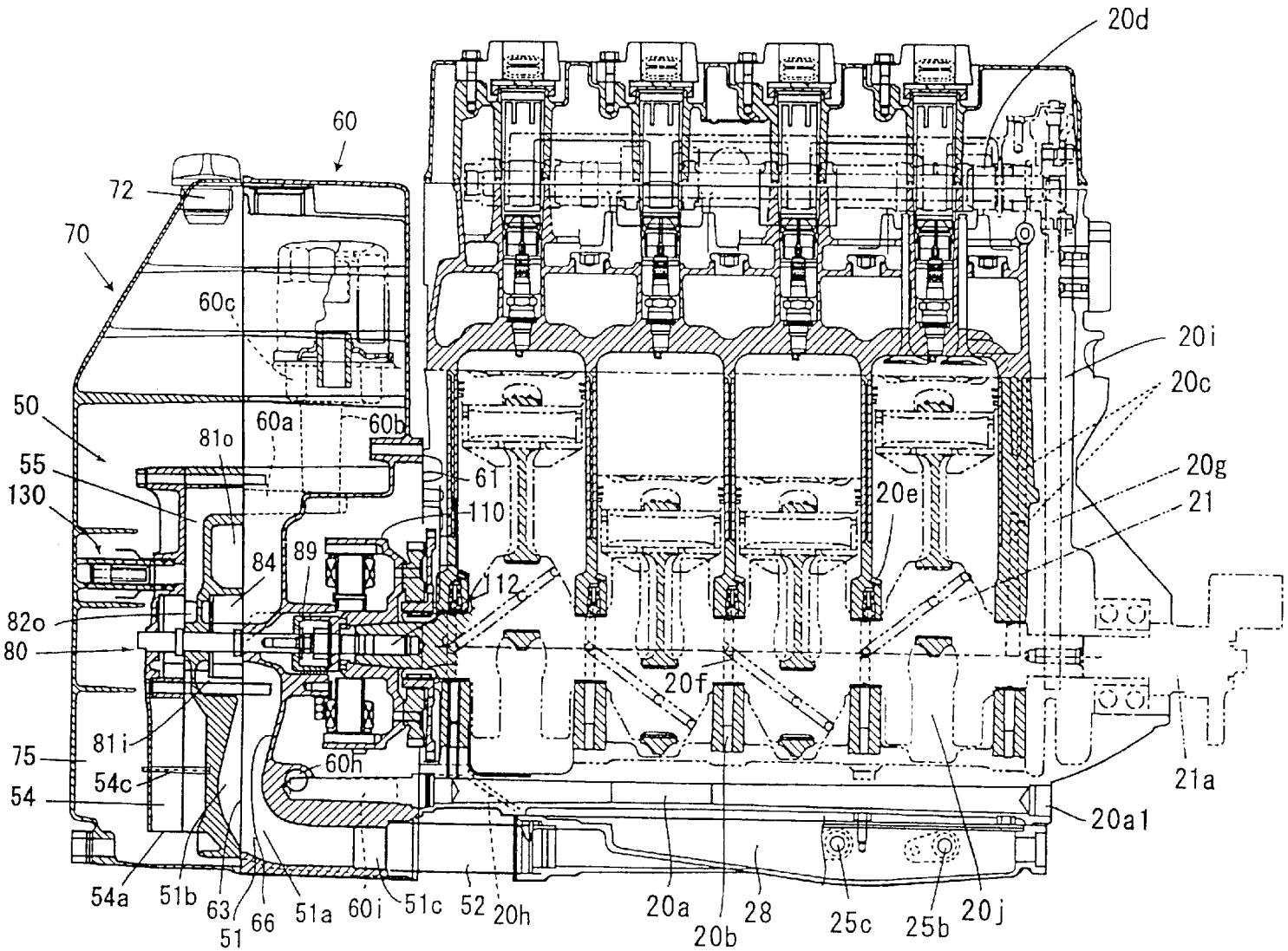
FIG. 5 is a right side elevational view of the engine 20.

FIG. 4 is a view principally showing the engine 20 and is a partial enlarged sectional view (partly omitted sectional view) taken along line IV—IV of FIG. 1. FIG. 5 is a right side elevational view of the engine 20, FIG. 6 is a left side elevational view of the engine 20, FIG. 7 is a schematic perspective view of the engine 20 as viewed from obliquely rearwardly, and FIG. 8 is a partial enlarged view of FIG. 5.

The engine 20 is a DOHC in-line four-cylinder dry sump type 4-cycle engine. The engine 20 is disposed such that the crankshaft 21*a* thereof extends in the forward and backward direction of the body 11 as shown in FIG. 1.

Figure 7:
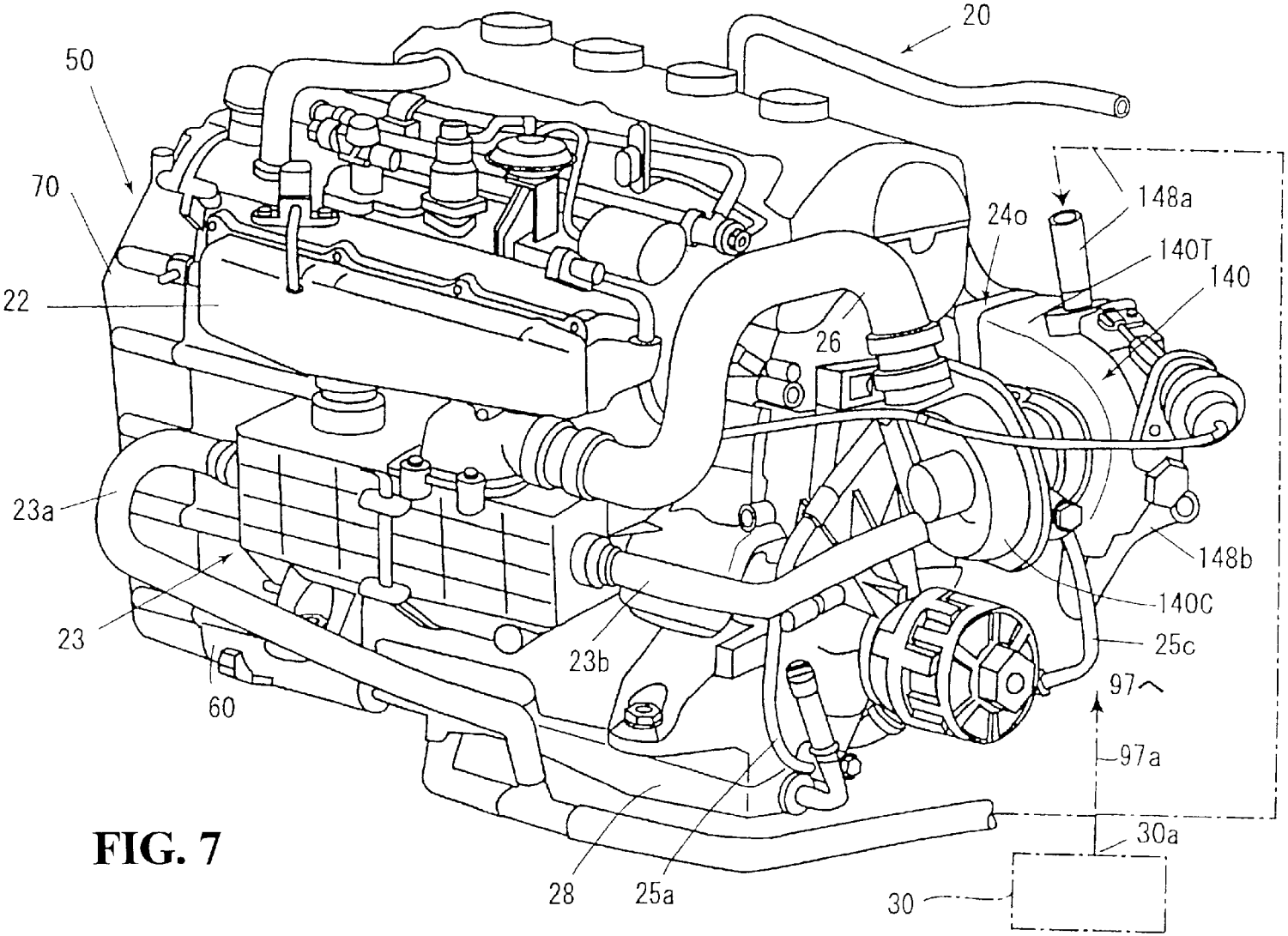
FIG. 7 is a schematic perspective view of the engine 20 as viewed from obliquely rearwardly.
Figure 8:
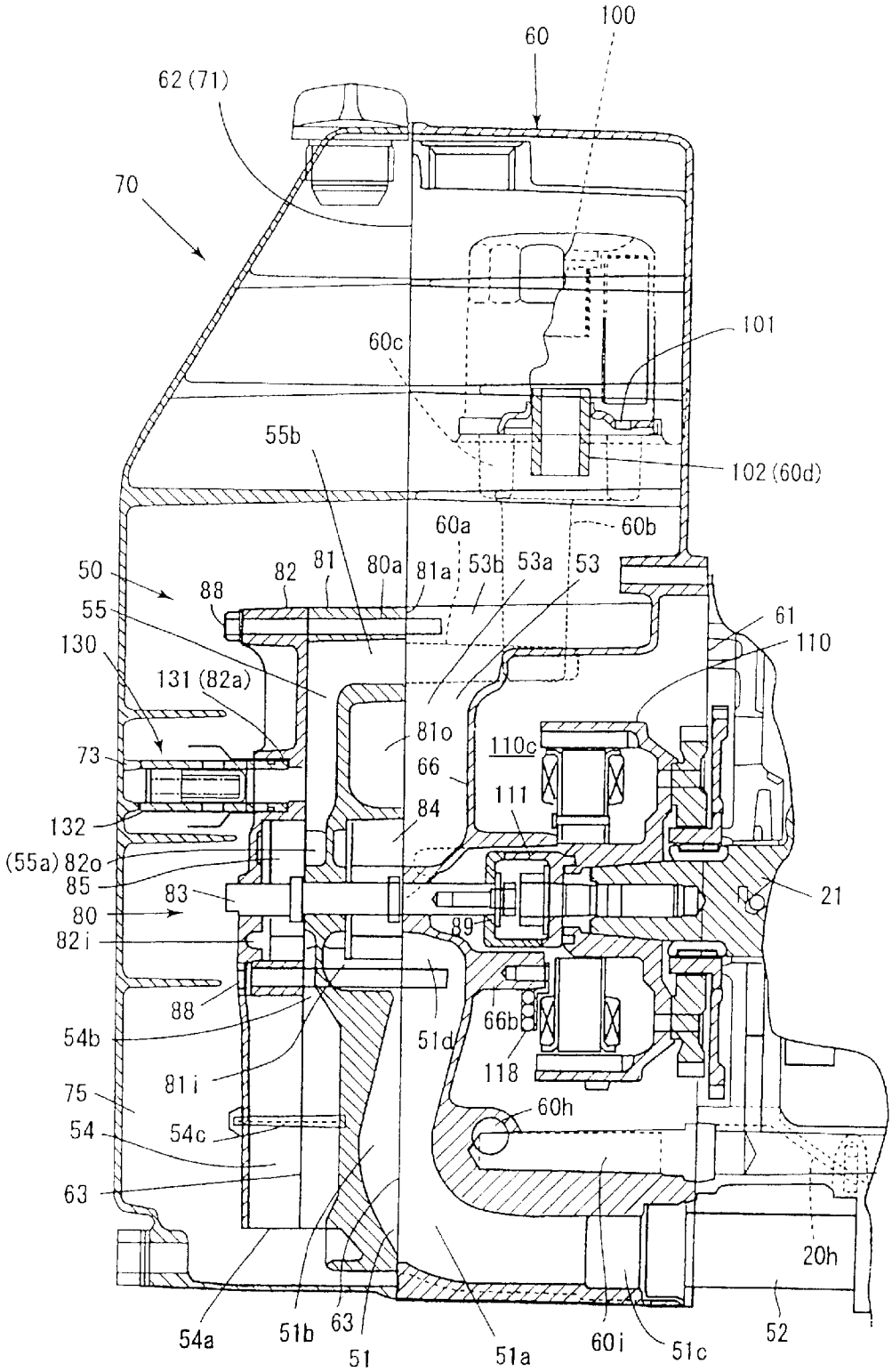
FIG. 8 is a partial enlarged view of FIG. 5.

As shown in FIGS. 4 and 7, a surge tank (intake chamber) 22 and an intercooler 23 communicated with an intake port are connected and disposed on the left side of the engine 20 with respect to the advancing direction of the body 11. An exhaust manifold 24 communicated with an exhaust port 200 is connected and disposed on the right side of the engine 20.

Figure 6:
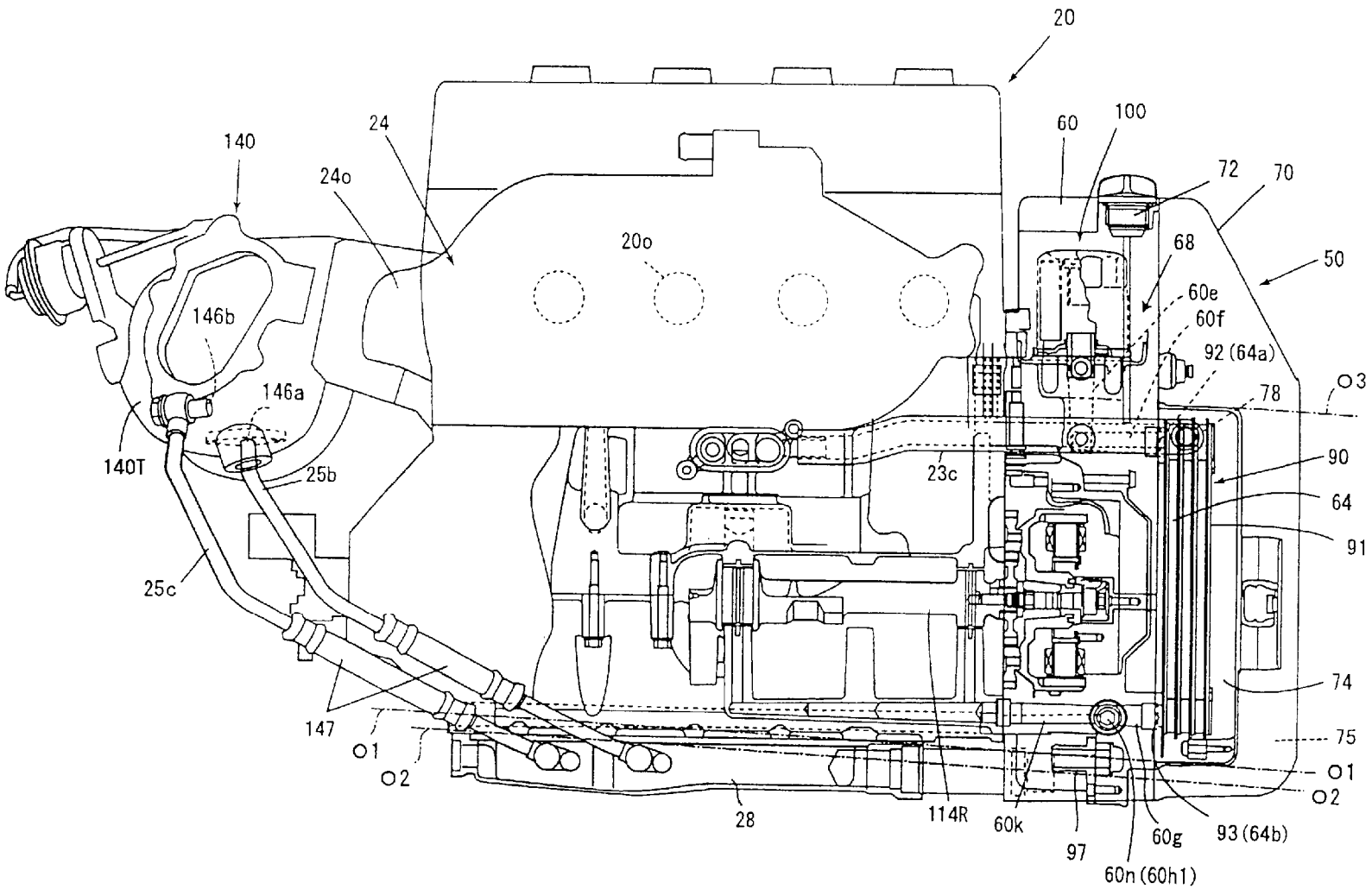
FIG. 6 is a left side elevational view of the engine 20.

As shown in FIGS. 6 and 7, a turbocharger (supercharger) 140 is disposed rearwardly of the engine 20, and an exhaust gas exit 24*o* of the exhaust manifold 24 is connected to a turbine portion 140T of the turbocharger 140. The intercooler 23 is connected to a compressor portion 140C of the turbocharger 140 by a pipe 26 (refer to FIG. 7). In FIG. 7, reference characters 23*a*, 23*b* denote each a cooling water hose connected to the intercooler 23.

It is to be noted that exhaust gas which has rotated a turbine in the turbine portion 140T of the turbocharger 140 passes, as shown in FIGS. 1 and 2, through an exhaust pipe 27*a*, a backflow preventing chamber 27*b* for preventing a backflow of water (admission of water into the turbocharger 140 and so forth) upon capsize, a water muffler 27*c* and an drain pipe 27*d*. Thereafter, the exhaust gas is exhausted into a water stream produced by the jet pump 30.

Referring to FIG. 1, each of intake ducts 18, 19 is provided for introducing the atmospheric air outside the body 11 into the space 16 in the body 11. The lower ends 18*a*, 19*a* of the intake ducts 18, 19 are provided in a position lower in the body 11 than the turbocharger 140 described above. In other words, the turbocharger 140 is provided higher than the openings 18*a*, 19*a* of the intake ducts 18, 19 in the body. The turbocharger 140 is provided substantially in the center in the vertical direction in the space 16 of the body.

As shown in FIGS. 4 to 7, an oil tank 50 and an oil pump 80 are provided integrally on an extension line of a crankshaft 21 at a front portion of the engine 20 (in the advancing direction of the body 11, and at a left portion in FIGS. 1 and 5). The oil pump 80 is provided in the oil tank 50.

The oil tank 50 is formed from a tank body (one divided case) 60 joined to a front face of the engine 20 and a cover (the other divided case) 70 joined to a front face of the tank body 60.

As shown in FIGS. 4 and 6, a water cooling type oil cooler 90 is provided on the front face of the tank body 60 in the oil tank 50, and an oil filter 100 is provided at an upper portion of the oil tank 50.

As shown in FIGS. 4, 5, and 8, the tank body 60 has a joining face 61 to the front face of the engine 20, a joining face 62 to the cover 70, and a mounting portion 63 for the oil pump 80, a mounting portion 64 for the water cooling type oil cooler 90. A generally vertically elongated oil accommodation portion 65 is defined by partition walls and outer walls which form the mounting surfaces of them, an ACG 110, balancer shafts 114L, 114R, and a cover portion 66 for a drive chamber of a starter motor 120. Further, as shown in FIG. 6, the tank body 60 has a mounting portion 68 for the oil filter 100.

The tank body 60 is joined at the joining face 61 thereof described above to the front face of the engine 20, and is integrally secured to the front face of the engine 20 by bolts (not shown), in such a manner that it covers the elements described above. It is to be noted that the tank body 60 is attached to the front face of the engine 20 after the oil pump 80 and the type oil cooler 90 are attached thereto.

The cover 70 has a joining face 71 to the tank body 60, a refilling opening 72 for oil, a holding portion 73 for a relief valve 130, an accommodation portion 74 (refer to FIG. 6) for the oil cooler 90, and an oil accommodation portion 75 defined by outer walls and a partition wall.

The oil pump 80 includes a first case 81 joined to the tank body 60 described above, a second case 82 joined to the first case 81, a pump shaft 83 provided such that it extends through the first and second cases. Further, the oil pump includes inner and outer rotors 84 coupled to the pump shaft 83 in the first case 81 described above for recovering oil, and inner and outer rotors 85 coupled to the pump shaft 83 in the second case 82 described above for supplying oil.

The inner and outer rotors 84 for recovering oil cooperates with the first case 81 to form an oil recovery pump, and the inner and outer rotors 85 for supplying oil cooperates with the first and second cases 81, 82 to form an oil supply pump. The oil pump 80 is attached to the front face of the tank body 60 by means of bolts 88 after the joining face of the first case 81 to the tank body 60 is attached to the mounting portion 63 on the front face of the tank body 60, the tank body being formed in the same shape as that of the joining face. After the oil pump 80 is attached to the tank body 60 in this manner, a coupling 89 is secured to the rear end of the pump shaft 83 from the rear face side of the tank body 60 by means of bolts.

Accordingly, the tank body 60 is attached to the front face of the engine 20 such that the coupling 89 is coupled to a coupling 111 provided at an end of an ACG shaft after the oil pump 80 and the coupling 89 are attached.

The water cooling type oil cooler 90 is attached to the front face side of the mounting portion 64 of the tank body 60 for the oil cooler 90. As shown in FIGS. 4 and 6, an upper hole 64*a* and a lower hole 64*b* which are communicated with an oil passage (described below) are formed in the mounting portion 64 of the tank body 60. Meanwhile, the oil cooler 90 has a plurality of heat exchanging plates 91, through the inside of which oil passes. The oil cooler also includes an entrance pipe 92 for oil communicated at an upper portion thereof with the inside of the plates 91, and an exit pipe 93 for oil communicated at a lower portion thereof with the inside of the plates 91. Accordingly, the oil cooler 90 is attached to the mounting portion 64 of the tank body 60, such that the entrance pipe 92 thereof is connected to the upper hole 64*a* of the tank body 60, and the exit pipe 93 thereof is connected to the lower hole 64*b* of the tank body 60.

As shown in FIGS. 4 and 6, a cooling water introduction pipe 97, which communicates with a hole 64*c*, opens to the mounting portion 64 and introduces cooling water into the accommodation portion 74 of the oil cooler in the mounting portion 64. The cover 70 is provided on the tank body 60, and a discharge pipe 78 for water is provided in the cover 70. A cooling water hole 97*a* from a cooling water output port 30*a* (refer to FIG. 7) of the jet pump 30 is connected directly to the introduction pipe 97 without intervention of any other cooling object, and an drain pipe 23*c* is connected to the discharge pipe 78 as shown in FIG. 6. Water from the discharge pipe 78 is supplied into the water jacket of the exhaust manifold 24 through the drain pipe 23*c*.

The cover 70 is joined to the front face of the tank body 60, and secured by means of bolts (not shown) such that a front end 132 of the relief valve 130 is held down by the holding portion 73 described above after the tank body 60, oil pump 80 and oil cooler 90 are attached to the front face of the engine 20 in the manner described above. Then a rear end 131 of the relief valve 130 is fitted into a hole 82*a* formed in the front face of the second case 82 of the oil pump 80 as shown in FIGS. 5 and 8. The relief valve 130 is disposed horizontally in this manner.

In the state wherein the tank body 60 and the cover 70 are joined together, a single oil accommodation section is formed from the oil accommodation portions 65, 75 of them. Further, the oil filter 100 is attached to the mounting portion 68 of the tank body 60 for the oil filter 100. It is to be noted that, in a state wherein the engine 20 is incorporated in the body 11, the engine 20 and the oil filter 100 are opposed to an opening 15*a* of the deck 15 as shown in FIGS. 2 and 4. The opening 15*a* of the deck 15 is opened by removing the seat 12, which is removably mounted on the body 11, from the body 11.

The oil passages described below are formed in a state wherein the oil tank 50 (that is, the tank body 60 and oil filter 100, the cover 70, and the oil pump 80, oil cooler 90, and relief valve 130 built in them) is mounted on the front face of the engine 20.

As shown in FIGS. 5 and 8, an oil recovery passage 51 is formed by the front face of the tank body 60 and the rear face of the first case 81 of the oil pump 80. The recovery passage 51 is formed from an oil passage 51*a* formed on the tank body 60 side and an oil passage 51*b* formed on the first case 81 side of the oil pump 80 in an opposing relationship to the oil passage 51*a*. A lower end 51*c* of the oil recovery passage 51 is communicated with an oil pan 28 of the engine 20 through a pipe 52, and an upper end 51*d* of the oil recovery passage 51 is communicated with a recovered oil inlet port 81*i* formed in the first case 81 of the oil pump 80.

Similarly, a discharge passage 53 for recovered oil is formed by the front face of the tank body 60 and the rear face of the first case 81 of the oil pump 80. The discharge passage 53 is formed from an oil passage 53*a* formed on the tank body 60 side and a recovered oil discharge port 81*o* formed on the first case 81 side of the oil pump 80 in an opposing relationship to the oil passage 53*a*. An upper end 53*b* of the discharge path 53 is open to the inside of the oil tank 50 (that is, to the inside of the oil accommodation section).

Meanwhile, an intake passage 54 and a discharge passage 55 for supply oil are formed by the front face of the first case 81 and the rear face of the second case 82 of the oil pump 80. A lower end 54*a* of the intake passage 54 is open to the inside of the oil tank 50 (that is, to the inside of the oil accommodation section), and an upper end 54*b* of the intake passage 54 is communicated with a supply oil inlet port 82*i* of the oil supply pump. A screen oil filter 54*c* is provided in the intake passage 54.

A lower end 55*a* of the discharge passage 55 is communicated with a supply oil discharge port 82*o* of the oil supply pump, and an upper end 55*b* of the discharge passage 55 extends horizontally through an upper portion of the first case 81 and is communicated with a horizontal hole 60*a* formed in the tank body 60. The horizontal hole 60*a* is communicated with a vertical hole 60*b* formed in the tank body 60 similarly. An upper end 60*c* of the vertical hole 60*b* is open in the form of a ring as viewed in plan to the mounting portion 68 of the oil filter 100, and an oil inlet passage 101 of the oil filter 100 is communicated with the opening 60*c*.

The mounting hole 82*a* for the relief valve 130 described above is open to the discharge passage 55, and the relief valve 130 is attached in such a manner as described above to the mounting hole 82*a*.

A male thread is provided on an oil exit pipe 102 in the oil filter 100. The oil filter 100 is attached to the mounting portion 68 of the tank body 60 by screwing the oil exit pipe 102 into a female threaded hole 60*d* formed in the mounting portion 68 of the tank body 60.

As shown in FIG. 6, a vertical hole 60*e* and a horizontal hole 60*f* communicating with a lower end of the vertical hole 60*e* are formed at a lower portion of the female threaded hole 60*d* in the tank body 60. The horizontal hole 60*f* is communicated with the entrance pipe 92 of the oil cooler 90 through the upper hole 64*a* of the mounting portion 64 of the oil cooler 90 described above.

Meanwhile, an oil passage 60*g* communicating with the lower hole 64*b* and an oil distributing passage 60*h* communicating with the passage 60*g* are formed in the lower hole 64*b* of the tank body 60 described hereinabove to which the exit pipe 93 of the oil cooler 90 is connected. Further, a main gallery supply passage 60*i* for supplying oil to a main gallery 20*a* (refer to FIG. 5) of the engine 20, a left balancer supply passage 60*j* for supplying oil to bearing portions of the left balancer 114L described above, and a right balancer supply passage 60*k* for supplying oil to bearing portions of the right balancer 114R are communicated with the oil distributing passage 60*h*. It is to be noted that one end of the oil distributing passage 60*h* is closed up with a plug 60*n* (refer to FIG. 6).

Figure 9:
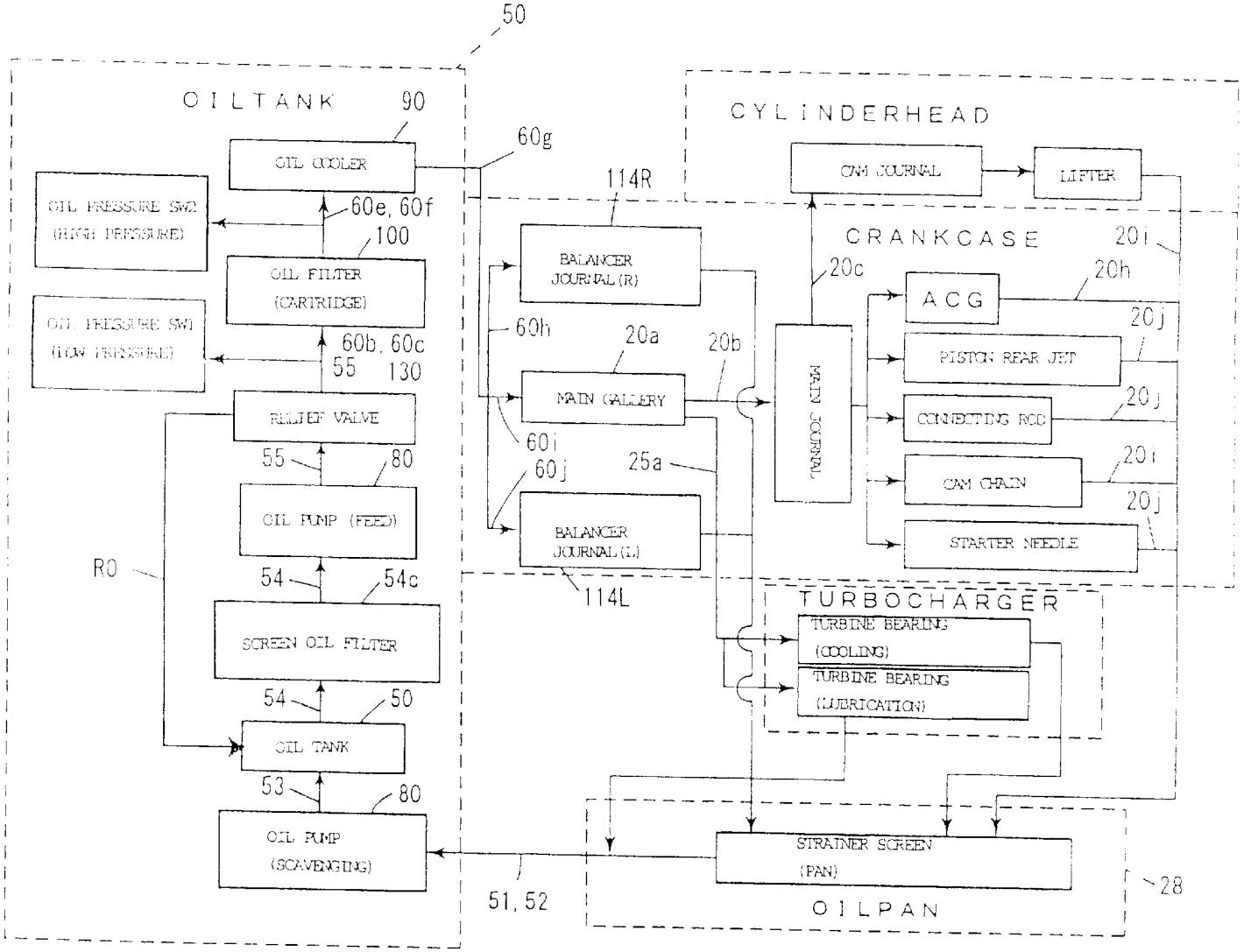
FIG. 9 is a view of a circulation route of oil.

The route of oil supplied to the main gallery 20*a* of the engine 20 is such as shown in FIG. 9 (oil circulation route diagram). The route from the main gallery 20*a* is generally divided into two.

The first route is a route along which oil is supplied to bearing portions of the crankshaft 21 through a route 20*b* (refer to FIG. 5), and the second route is a route along which oil is supplied from a rear end 20al of the main gallery 20*a* through a pipe 25*a* (refer to FIG. 7) to cool and lubricate turbine bearings of the turbocharger 140. The oil which has cooled and lubricated the turbine bearings of the turbocharger 140 is recovered into the oil pan 28 through pipes 25*b*, 25*c* (refer to FIG. 6). The oil supplied to the bearing portions of the crankshaft 21 further lubricates cam journal 20*d* portions and lifter portions of a cylinder head through a route 20*c*, and then returns to the oil pan 28 through a chain chamber 20*i*.

Meanwhile, the oil supplied to the bearing portions of the crankshaft 21 is further supplied to the ACG, piston rear jet nozzles, connecting rod, cam chain and starter needle and is recovered into the oil pan 28 through respective recovery passages. In FIG. 5, reference character 20*e* denotes a jet nozzle for jetting oil to the rear side of the piston to cool the piston, 20*f* a passage to the connecting rod portion, and 20*g* the cam chain. Further, reference character return passage 20*h* denotes a returning passage for oil from an ACG chamber 110*c*. The oil in the ACG chamber returns to the oil pan 28 through a return passage 20*h* therefor, and the oil jetted to the rears of the pistons from jet nozzles 20*e*, the oil supplied to the connecting rod and the oil supplied to the starter needle return to the oil pan 28 individually through a crank chamber 20*j*.

As apparent from the foregoing description, a general flow of oil is described below and is shown in FIG. 9.

The oil tank 50→intake passage 54→screen oil filter 54*c*→oil pump (supply pump) 80→discharge passage 55 (and relief valve 130, horizontal hole 60*a*, vertical hole 60*b*, ring-form opening 60*c*)→oil filter 100→vertical hole 60*e*, horizontal hole 60*f*→oil cooler 90→oil passage 60*g*, oil distributing passage 60*h*→main gallery supply passage 60*i*, left balancer supply passage 60*j*, right balancer supply passage 60*k*→main gallery 20*a*, left balancer 114L, right balancer 114R.

Relief oil RO from the relief valve 130 returns directly into the oil tank 50. Oil supplied to the left balancer 114L, right balancer 114R returns to the oil pan 28 through the crank chamber 20*j*.

Meanwhile, oil supplied to the various portions described above from the main gallery 20*a* returns to the oil pan 28 in such a manner as described above. Then, the oil returned to the oil pan 28 is recovered into the oil tank 50 through the pipe 52, recovery passage 51, oil pump 80 (recovery pump) and recovered oil discharge path 53, and is circulated by the route described above from the intake passage 54.

Figure 10:
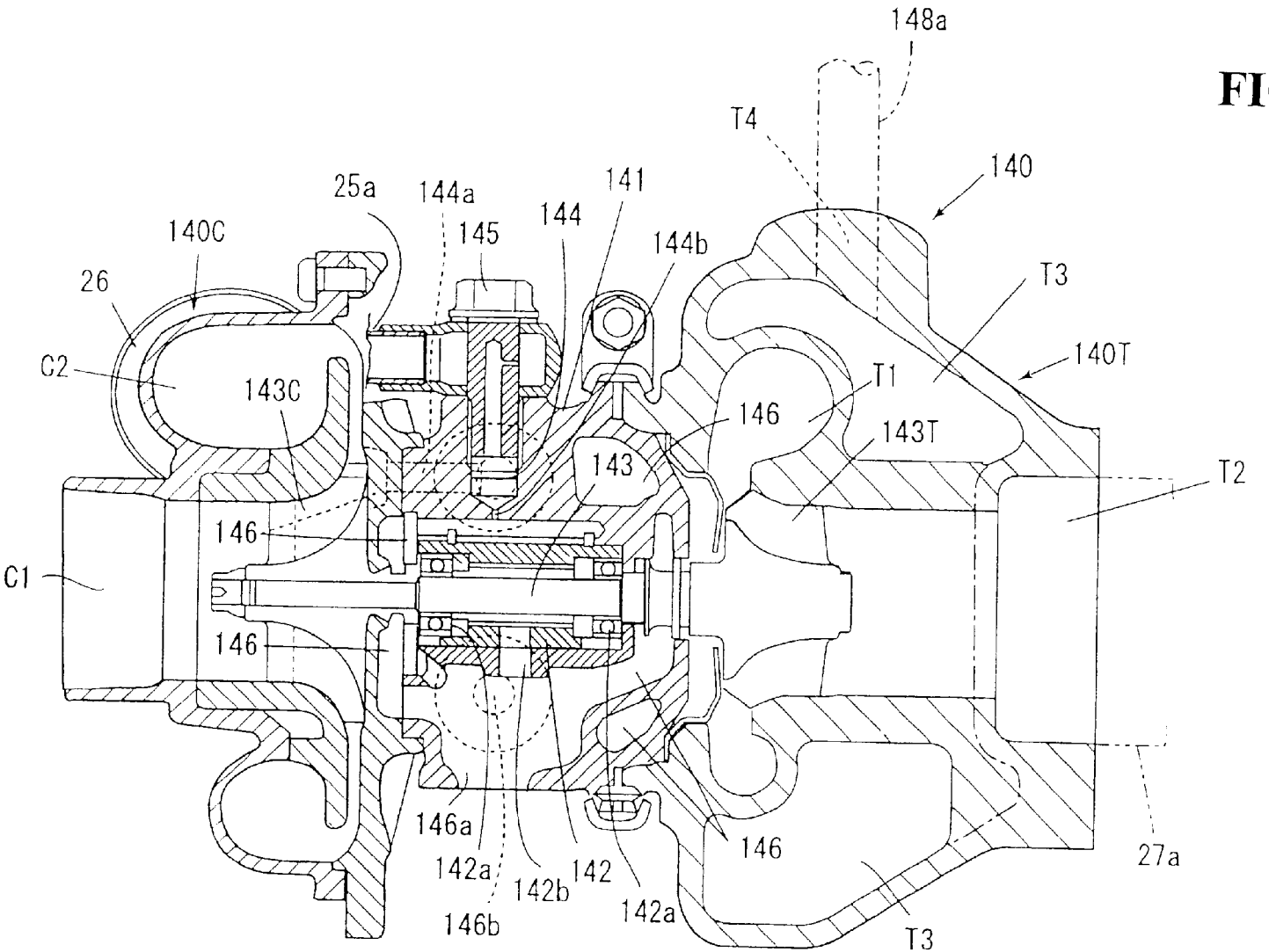
FIG. 10 is a sectional view of a turbocharger 140.
Figure 11:
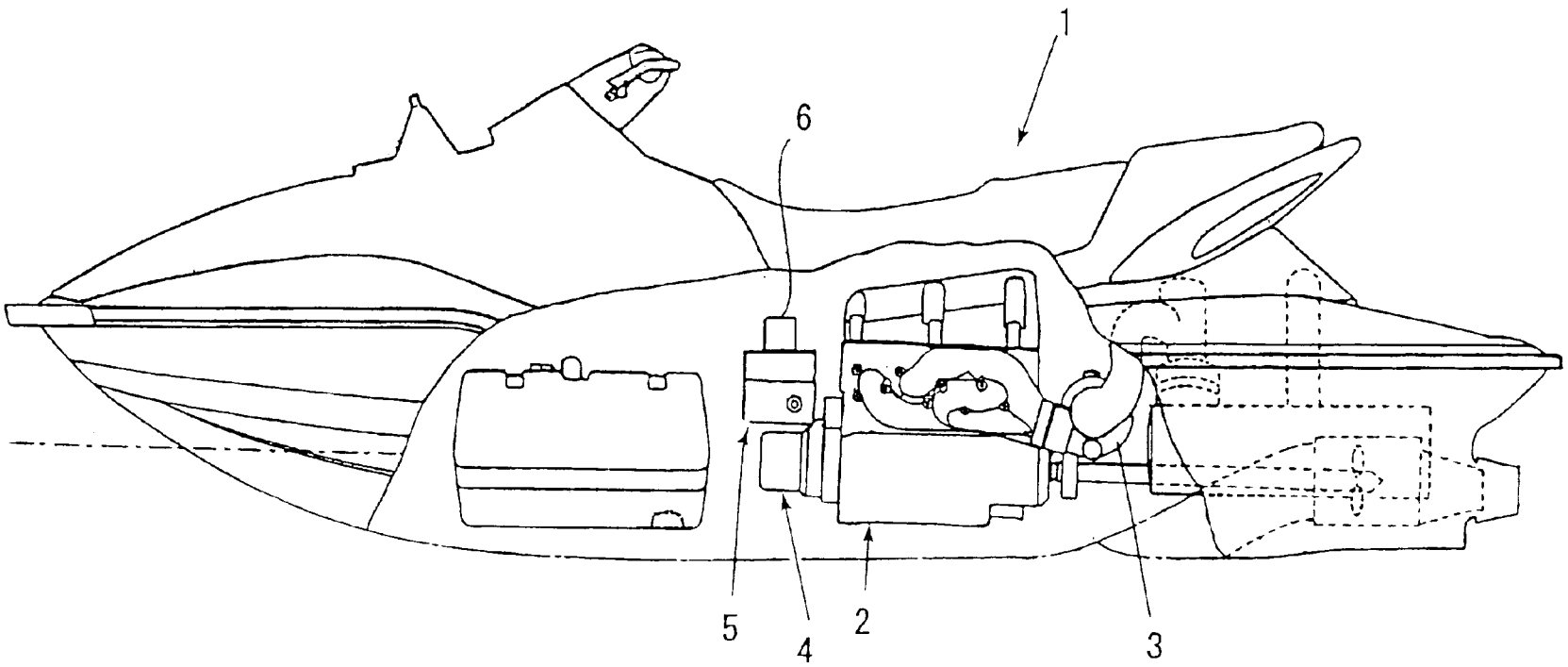
PRIOR ART FIG. 11
FIG. 11 is an explanatory view of the prior art.
Figure 12:
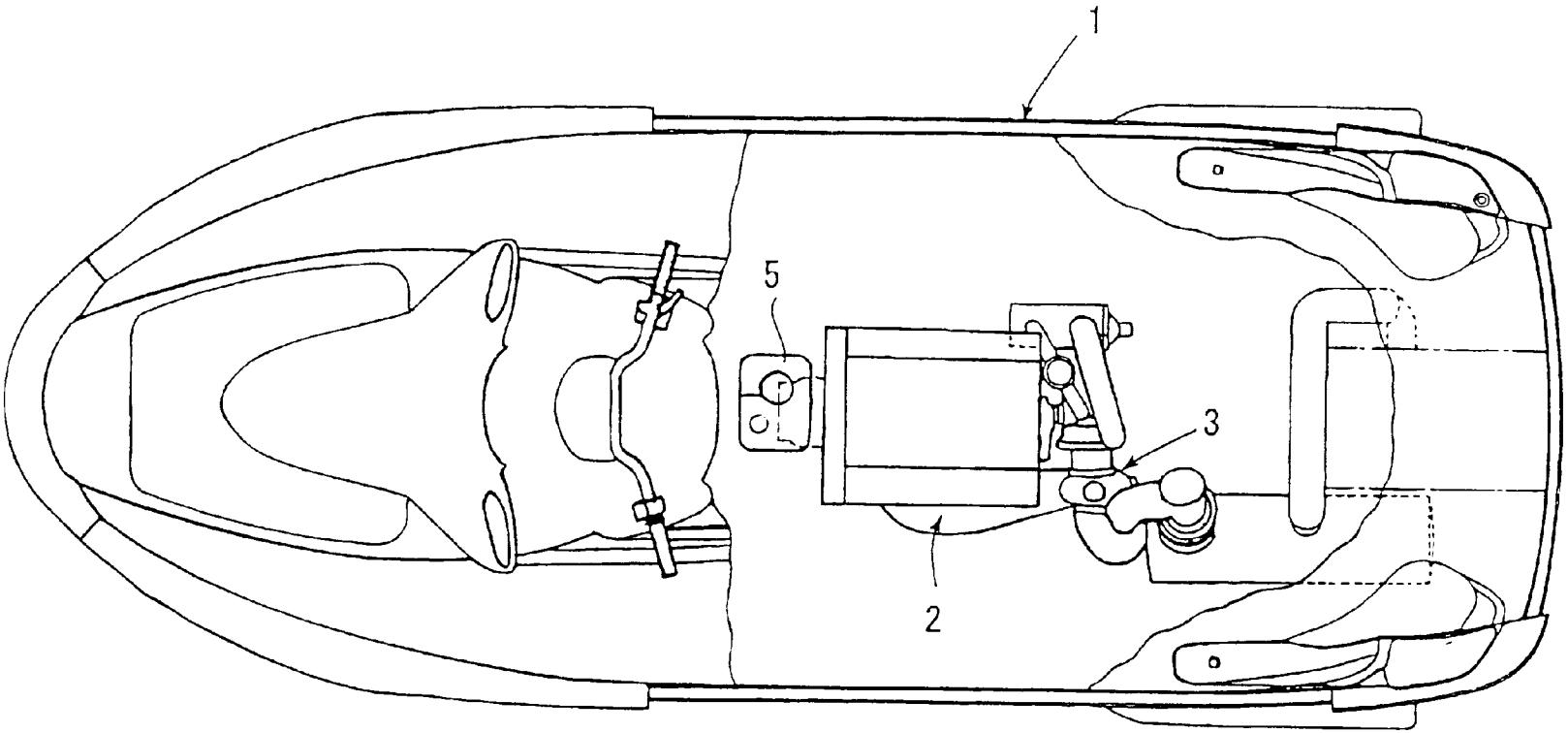
PRIOR ART FIG. 12
FIG. 12 is an explanatory view of the prior art.

FIG. 10 is a sectional view of the turbocharger 140. As described above, the turbocharger 140 includes the turbine portion 140T and the compressor portion 140C. The turbocharger 140 further includes a bearing casing 141 which interconnects the turbine portion 140T and the compressor portion 140C.

A bearing portion (accommodation chamber for a bearing member) 142 is provided in the bearing casing 141, and a turbine shaft 143 is supported for rotation by bearing members (ceramic ball bearings) 142*a* of the bearing portion 142. Turbine blades 143T are secured to the turbine shaft 143 adjacent the turbine portion 140T, and compressor blades 143C are secured to the turbine shaft 143 adjacent the compressor portion 140C.

Accordingly, within a process wherein exhaust gas from the exhaust manifold 24 described above is exhausted from an exhaust gas exit T2 to the exhaust pipe 27*a* (refer to FIGS. 1 and 2) described above through an exhaust passage T1 in the turbine portion 140T, the turbine shaft 143 is driven to rotate. Thus, the compressor blades 143C are driven to rotate so that air from an intake air inlet port C1 communicating with an intake box (not shown) is fed under pressure from the pipe 26 (refer to FIG. 7) to the intercooler 23 through an intake passage C2 in the compressor portion 140C.

An oil entrance 144 is provided at an upper portion of the bearing casing 141. The oil entrance 144 is communicated with the rear end portion 20al of the main gallery 20*a* by the pipe 25*a* (refer to FIG. 7) described above, which services as an oil supply passage. The pipe 25*a* is connected to the oil entrance 144 by an orifice bolt 145.

An oil jacket 146 is formed in the inside of the bearing casing 141, and the oil entrance 144 described above is communicated with the oil jacket 146 by an oil passage 144*a*. The bearing portion 142 is communicated with the oil entrance 144 by a thin oil passage 144*b*.

Accordingly, oil entering from the oil entrance 144 is supplied from the oil passage 144*a* to the oil jacket 146 to cool the bearing casing 141, bearing portion 142, turbine shaft 143 and members around them, and is supplied from the oil passage 144*b* to the bearing portion 142 to lubricate the bearing portion 142. The oil of the oil jacket 146 is recovered into the oil pan 28 from oil exits 146*a* and 146*b* of the oil jacket 146 through the pipes 25*b*, 25*c* (refer to FIG. 6) described above. Meanwhile, the oil of the bearing portion 142 once enters the oil jacket 146 from an exit 142*b* of the bearing portion 142 and then is recovered into the oil pan 28 from the oil exits 146*a* and 146*b* of the oil jacket 146 described above through the pipes 25*b*, 25*c* (refer to FIG. 6) described above.

The pipe 25*b* is connected to the oil exit 146*a*, and the pipe 25*c* is connected to the oil exit 146*b*. The oil exits 146*a*, 146*b* are disposed higher than an oil surface O1 (refer to FIG. 6) when the engine is not running.

It is to be noted that the oil surface O1 indicates the position of the oil surface at a point of time when several minutes elapse after the engine stops. When several days elapse after the engine stops, the oil surface rises higher than the O1 position, and yet, it does not reach the oil exits 146*a*, 146*b*. Further, in FIG. 6, reference character O2 denotes the oil surface when the engine is operating, and O3 the oil surface in the oil tank 50. The oil surfaces O1, O2, O3 are inclined, in FIG. 6, by approximately 3° in the forward and backward direction with respect to the axial line of the crankshaft from a relationship of the inclination when the engine 20 is incorporated in the body 11.

Further, a one-way valve 147 is interposed in each of the pipes 25*b*, 25*c* which serve as an oil returning path.

As shown in FIG. 10, a water jacket T3 is formed in the casing of the turbine portion 140T. An entrance T4 for cooling water of the water jacket T3 is connected to the cooling water output port 30*a* (refer to FIG. 7) of the jet pump 30 described above by a pipe 148*a* which forms a different supercharger cooling water passage independent of the other cooling water passages. Further, an exit (not shown) of the water jacket T3 for cooling water is connected to a water jacket of the exhaust pipe 27*a* (refer to FIGS. 1, 2) by a pipe 148*b* shown in FIG. 7.

Accordingly, cooling water from the jet pump 30 is supplied to the water jacket T3 of the turbocharger 140 directly without intervention of any other cooling object and cools the turbocharger 140, whereafter it cools the exhaust pipe 27*a*. It is to be noted that the water having cooled the exhaust pipe 27*a* further flows into a water jacket of the backflow preventing chamber 27*b* to cool the backflow preventing chamber 27*b* and is then jetted into the water muffler 27*c*. The water is then discharged together with exhaust gas into water current produced by the jet pump 30 through the exhaust and drain pipe 27*d*.

The personal watercraft having an engine and a supercharger incorporated therein as described above, results in the following operation and effects:

(a) Since the engine 20 is provided in the body 11 formed from the hull 14 and the deck 15 and the supercharger 140 is provided for the engine 20, and the oil exits 146*a*, 146*b* of the supercharger 140 are disposed higher than the oil surface O1, when the engine is not running, and if the engine 20 and the oil pump are stopped, the oil in the supercharger 140 is discharged quickly from the oil exits 146*a*, 146*b*.

Accordingly, the oil resident in the supercharger 140 after the engine stops can be minimized, thus reducing the degradation of the entire oil supply.

(b) Since the engine 20 is a dry sump type engine and the oil tank 50 is provided on an extension line of the crankshaft thereof, the oil surface O1 when the engine is not running can be set low.

Accordingly, oil in the supercharger 140 is discharged further quickly from the oil exits 146*a*, 146*b*, and as a result, the deterioration of the entire oil supply is further reduced.

(c) Since the one-way valve 147 is interposed in each of the oil returning passages 25*b*, 25*c* communicated with the oil exits 146*a*, 146*b* of the supercharger 140, when the personal watercraft 10 capsizes, a situation in oil tries to reverse its flow from the oil pan 28 to enter the high-temperature supercharger 140 can be prevented.

Accordingly, carbonization of oil can be prevented, and degradation of the entire oil supply can be reduced with a higher degree of certainty.

(d) Since the supercharger 140 and an end portion of the main gallery 20*a* for oil provided in parallel to the crankshaft 21 of the engine 20 are communicated with each other by the oil supply passage 25*a*, oil to the supercharger 140 is supplied from the end portion of the main gallery 20*a* to the supercharger 140 directly through the oil supply passage 25*a*.

Accordingly, the time until oil is supplied to the supercharger 140 after the engine is started is reduced, and quick and reliable operation of the supercharger 140 can be achieved.

Figure 13:
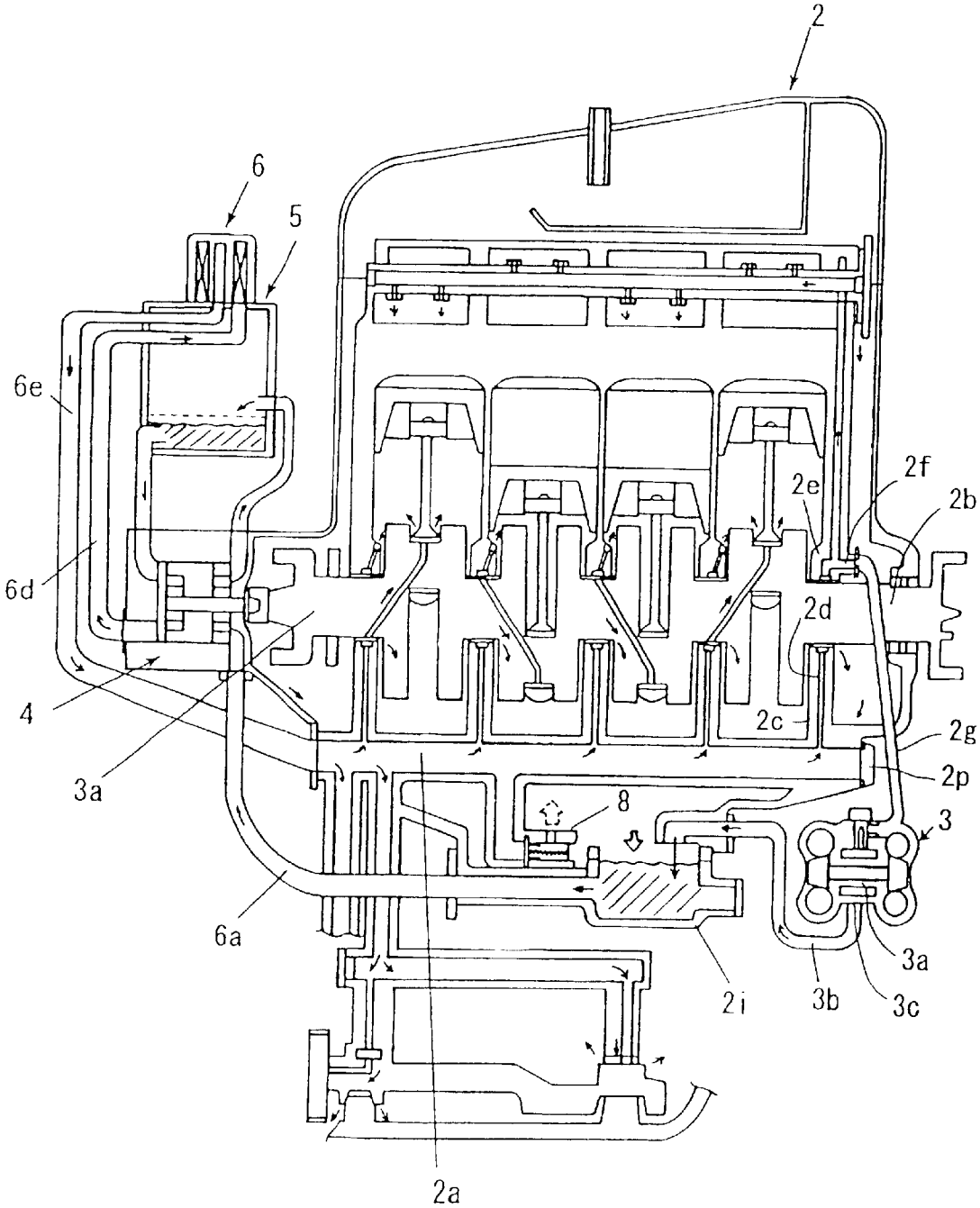
FIG. 13 PRIOR ART
FIG. 13 is an explanatory view of the prior art.

Also, whereas in the prior art described above, it is necessary to close up one end portion of the main gallery with a plug (refer to reference character 2*p* in FIG. 13), with the personal watercraft of the present embodiment having an engine with a supercharger incorporated therein, the plug is unnecessary.

(e) Since the oil pump 80 is provided on the front side of the body 11 with respect to the engine 20 while the supercharger 140 is provided on the rear side of the body 11, and the supercharger 140 and the rear end portion of the main gallery 20*a* are communicated with each other by the oil supply passage 25*a*, oil can be supplied rapidly to the supercharger 140 rearwardly of the engine.

(f) Since oil supplied to the supercharger 140 is used to lubricate the bearing portion 142 of the supercharger 140 and is supplied to the oil jacket 146 formed in the bearing casing 141 to cool the bearing casing 141, not only the bearing portion 142 of the supercharger 140 can be lubricated, but also, the bearing casing 141 can be cooled.

Further, since lubrication of the bearing portion 142 of the supercharger 140 and cooling of the bearing casing 141 are performed with oil supplied to the supercharger 140 in this manner, it is necessary to quickly supply a greater amount of oil than ever to the supercharger 140. However, with the personal watercraft 10 of the present embodiment, since the oil to the supercharger 140 is supplied from the end portion of the main gallery 20*a* directly to the supercharger 140 through the oil supply passage 25*a*, a greater amount of oil can be supplied rapidly.

(g) Since the personal watercraft of the present invention having an engine and a supercharger is structured such that cooling water from the pump 30 is supplied to the supercharger 140 by the different supercharger cooling water passage 148*a* independent of any other cooling water passage, the supercharger 140 can be cooled efficiently and sufficiently.

(h) Since the cooling water from the supercharger cooling water passage 148*a* is first supplied to the supercharger 140 to cool the supercharger 140, and is then supplied to the exhaust system (exhaust pipe 27*a*, backflow preventing chamber 27*b*, water muffler 27*c*, exhaust and drain pipe 27*d*) provided on the downstream with respect to the supercharger 140 in the exhaust system for the engine 20, the supercharger 140 can be cooled with cooling water in a state whose temperature is lowest.

Accordingly, the supercharger 140 can be cooled further efficiently and sufficiently. Further, also the exhaust system provided on the downstream with respect to the supercharger 140 can be cooled.

(k) Since the cooling water having cooled the supercharger 140 is discharged to the outside of the gliding boat 10 together with exhaust gas after it is supplied to the exhaust pipe 27*a* provided downstream in the exhaust system with respect to the supercharger 140, the exhaust gas which has driven the supercharger 140 is further cooled in the exhaust pipe 27*a*.

In other words, since the exhaust gas is cooled in the supercharger 140 and the exhaust pipe 27*a*, the exhaust gas energy can be reduced synergetically, and as a result, the exhaust noise can be reduced.

(l) Since oil is supplied to the supercharger 140, and the oil thus supplied is used to lubricate the bearing portion 142 of the supercharger 140, and the oil is also supplied to the oil jacket 146 formed in the bearing casing 141 to cool the bearing casing 141, the supercharger 140 is cooled more effectively.

(m) The hull 14 and the deck 15 of the personal watercraft are formed watertight and the opening 15*a* of the deck 15 is closed up with the lid member 12 to form the body internal space 16. Further, the intake ducts 18, 19 for introducing the atmospheric air outside the body are provided in the space 16 and the engine 20, and the turbocharger 140 connected to the exhaust manifold 24 of the engine 20 are provided in the space 16 and besides the turbocharger 140 is disposed higher than the body internal openings 18*a*, 19*a* of the intake ducts 18, 19. Therefore, when the atmospheric air outside the body is introduced into the body internal space 16 through the intake ducts 18, 19 during running of the personal watercraft, even if air is introduced together with water (for example, in the form of droplets), a situation in which the turbocharger 140 becomes wet with the water is less likely to occur.

Accordingly, situations in which the high-temperature casing of the turbocharger 140 is suddenly subjected to partial cooling, becomes less likely to occur. Thus, thermal fatigue of the turbocharger 140 becomes less likely to occur. As a result, the durability of the turbocharger 140 is increased.

(n) The water jacket T3 is formed in the casing of the turbine portion 140T of the turbocharger 140, and the oil jacket 146 is formed in the bearing casing 141 for the turbocharger 140, and cooling water is supplied to the water jacket T3 and cooling oil is supplied to the oil jacket 146. Consequently, a situation in which the temperature of the turbocharger 140 becomes excessively high can be eliminated.

Accordingly, when the atmospheric air outside the body is introduced into the body internal space 16 through the intake ducts 18, 19 during running of the personal watercraft, even if it is introduced together with water in the form of droplets, and the turbocharger 140 becomes wet with the water, the temperature variation of the casing of the turbocharger 140 can be kept small. As a result, thermal fatigue of the turbocharger 140 becomes less likely to occur, and the durability of the turbocharger 140 is increased.

(o) Since cooling water for the water jacket T3 is supplied through the different turbocharger cooling water passage 148*a* independent of the other cooling water passages, the turbocharger 140 is cooled efficiently.

Accordingly, when the atmospheric air outside the body is introduced into the body internal space 16 through the intake ducts 18, 19 during running of the personal watercraft, even if it is introduced together with water (for example, in the form of droplets) and the turbocharger 140 becomes wet with the water, the temperature variation of the casing of the turbocharger 140 can be kept small.

As a result, thermal fatigue of the turbocharger 140 becomes further less likely to occur, and the durability of the turbocharger 140 is increased with a higher degree of certainty.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A personal watercraft having an engine with a supercharger incorporated therein, comprising:

a body formed from a hull and a deck, said engine being provided in said body and said supercharger being provided for said engine, a first oil exit of said supercharger disposed higher than an oil surface when said engine is not running; and an oil pump provided on a front side of the engine, said supercharger being provided on a rear side of the engine, the supercharger and a rear end portion of a main gallery being in communication with each other through an oil passage for directly supplying oil to the supercharger.

2. The personal watercraft having an engine with a supercharger incorporated therein according to claim 1, wherein said engine is a dry sump engine, and an oil tank is provided on an extension line of a crankshaft of said engine.

3. The personal watercraft having an engine with a supercharger incorporated therein according to claim 1, further comprising a first one-way valve interposed in a first oil returning passage which communicates with said first oil exit of said super charger.

4. The personal watercraft having an engine with a supercharger incorporated therein according to claim 1, further comprising a second one-way valve interposed on a second oil returning passage which communicates with a second oil exit of said supercharger.

5. The personal watercraft having an engine with a supercharger incorporated therein according to claim 1, wherein said supercharger is provider higher than openings of intake ducts in said body.

6. The personal watercraft having an engine with a supercharger incorporated therein according to claim 1, wherein an oil tank is provided integrally with said oil pump on an extension line of a crankshaft at said front side of said engine.

7. A personal watercraft having an engine with a supercharger incorporated therein, comprising:

a body formed from a hull and a deck, said engine being provided in said body and said supercharger being provided for said engine;

an end portion of a main gallery of said engine provided in parallel to a crankshaft of said engine;

an oil supply passage connecting said end portion of said main gallery and said supercharger; and a first oil exit of said supercharger disposed higher than an oil surface when said engine is not running, wherein oil supplied to the supercharger through the oil supply passage is used to lubricate a bearing portion of the supercharger and is supplied to an oil jacket formed in a bearing casing to cool the bearing casing.

8. The personal watercraft having an engine with a supercharger incorporated therein according to claim 7, wherein said engine is a dry sump engine, and an oil tank is provided on an extension line of a crankshaft of said engine.

9. The personal watercraft having an engine with a supercharger incorporated therein according to claim 7, further comprising a first one-way valve interposed in a first oil returning passage which communicates with said first oil exit of said super charger.

10. The personal watercraft having an engine with a supercharger incorporated therein according to claim 7, further comprising a second one-way valve interposed on a second oil returning passage which communicates with a second oil exit of said supercharger.

11. The personal watercraft having an engine with a supercharger incorporated therein according to claim 7, wherein said supercharger is provider higher than openings of intake ducts in said body.

12. The personal watercraft having an engine with a supercharger incorporated therein according to claim 7, further comprising an oil pump provided on a front side of said engine, and said supercharger is provided on a rear side of said engine, and the supercharger and said rear end portion of said main gallery communicate with each other through said oil passage, for directly supplying said oil to said supercharger.

13. The personal watercraft having an engine with a supercharger incorporated therein according to claim 12, wherein an oil tank is provided integrally with said oil pump on an extension line of a crankshaft at said front side of said engine.

14. A personal watercraft having an engine with a supercharger incorporated therein, comprising:

a body formed from a hull and a deck, said engine being provided in said body and said supercharger being provided for said engine;

a first oil exit of said supercharger disposed rearward of said engine and higher than an oil surface when said engine is not running; and wherein the supercharger is cooled by oil supplied to an oil jacket formed in a bearing casing of the supercharger, and by cooling water supplied to a water jacket of the supercharger, and wherein the cooling water is first supplied to the supercharger and then supplied to an exhaust system for the engine.

15. The personal watercraft having an engine with a supercharger incorporated therein according to claim 14, wherein said engine is a dry sump engine, and an oil tank is provided on an extension line of a crankshaft of said engine.

16. The personal watercraft having an engine with a supercharger incorporated therein according to claim 14, further comprising a first one-way valve interposed in a first oil returning passage which communicates with said first oil exit of said super charger.

17. The personal watercraft having an engine with a supercharger incorporated therein according to claim 14, further comprising a second one-way valve interposed on a second oil returning passage which communicates with a second oil exit of said supercharger.

18. The personal watercraft having an engine with a supercharger incorporated therein according to claim 14, wherein said supercharger is provider higher than openings of intake ducts in said body.

19. The personal watercraft having an engine with a supercharger incorporated therein according to claim 14, further comprising an oil pump is provided on a front side of said engine, and said supercharger is provided on a rear side of said engine, and the supercharger and a rear end portion of a main gallery communicate with each other through an oil passage for directly supplying said oil to said supercharger.

20. The personal watercraft having an engine with a supercharger incorporated therein according to claim 19, wherein an oil tank is provided integrally with said oil pump on an extension line of a crankshaft at said front side of said engine.

21. A personal watercraft having an engine with a supercharger incorporated therein, comprising:

a body formed of a hull and a deck, said engine being provided in said body and said supercharger being provided for said engine, a first oil exit of said supercharger disposed higher than an oil surface when said engine is not running; and an oil tank is provided on a front side of the engine, said supercharger being provided on a rear side of the engine, the supercharger and a rear end portion of a main gallery being in communication each other through an oil passage for directly supplying oil to the supercharger.

* * * * *